US007108105B2

(12) United States Patent
Assirelli

(10) Patent No.: US 7,108,105 B2
(45) Date of Patent: Sep. 19, 2006

(54) CABLE LIFT WITHOUT A MACHINE ROOM

(75) Inventor: Eros Assirelli, Milan (IT)

(73) Assignee: SPACE LIFT S.R.L., Borgo Maggiore (SM)

( * ) Notice: Subject to any disclaimer, the term of this patent is extended or adjusted under 35 U.S.C. 154(b) by 0 days.

(21) Appl. No.: 10/344,035

(22) PCT Filed: Aug. 1, 2001

(86) PCT No.: PCT/IT01/00427

§ 371 (c)(1),
(2), (4) Date: Aug. 8, 2003

(87) PCT Pub. No.: WO02/12107

PCT Pub. Date: Feb. 14, 2002

(65) Prior Publication Data

US 2004/0026179 A1 Feb. 12, 2004

(30) Foreign Application Priority Data

Aug. 7, 2000 (EP) ..... 00830563

(51) Int. Cl.
*B66B 1/00* (2006.01)

(52) U.S. Cl. ..... 187/277; 187/254

(58) Field of Classification Search ..... 187/251, 187/254, 256, 266, 289, 293, 413, 277
See application file for complete search history.

(56) References Cited

U.S. PATENT DOCUMENTS 5,036,954 A 8/1991 Haahtikivi et al.
5,690,578 A * 11/1997 Hall, III ..... 475/269
5,740,888 A * 4/1998 Aulanko et al. ..... 187/336
5,890,565 A * 4/1999 Wang ..... 187/263
6,039,152 A * 3/2000 Schops et al. ..... 187/414
6,148,962 A * 11/2000 Hakala et al. ..... 187/254
6,247,557 B1 * 6/2001 Kobayashi et al. ..... 187/266
6,273,216 B1 * 8/2001 Kocher et al. ..... 187/377
6,382,361 B1 * 5/2002 Nihei et al. ..... 187/289
6,397,975 B1 * 6/2002 Rutten ..... 187/266
6,427,809 B1 * 8/2002 Bammert ..... 187/391
6,488,124 B1 * 12/2002 Yasuda et al. ..... 187/254
6,598,707 B1 * 7/2003 Nakagaki et al. ..... 187/256
6,619,433 B1 * 9/2003 Robert et al. ..... 187/251
6,651,780 B1 * 11/2003 Hakala et al. ..... 187/254
6,742,628 B1 * 6/2004 Bauer ..... 187/254
2002/0017434 A1 * 2/2002 Orrman et al. ..... 187/254
2003/0057028 A1 * 3/2003 Cholinski ..... 187/263
2003/0168287 A1 * 9/2003 Helmle ..... 187/288

FOREIGN PATENT DOCUMENTS

DE 197 52 232 A1 5/1999
DE 199 02 853 A1 9/1999
EP 0 631 966 A2 1/1995
EP 0 905 081 A2 3/1999
EP 1031528 A1 * 8/2000

* cited by examiner

*Primary Examiner*—Jonathan Salata
(74) *Attorney, Agent, or Firm*—Browdy and Neimark, PLLC

(57) ABSTRACT

In a cable lift, with a single compartment or shaft (1) for housing a movable cage (2) and an apparatus (3), comprising at least one fixed winch (4) and a counterweight (5), for displacement of the cage (2), the counterweight (5) performs travel movements shorter than those of the cage (2) so that a part (1*a*) of the shaft (1) is always free to house the winch (4) therein. The latter, in particular, comprises a traction pulley (4*c*) with its axis (4*a*) parallel to a wall (1*b*) of the shaft (1), next to which it is arranged.

5 Claims, 4 Drawing Sheets

CABLE LIFT WITHOUT A MACHINE ROOM

DESCRIPTION

TECHNICAL FIELD

The present invention relates to a cable lift.

In conventional embodiments a cable lift requires the presence of two distinct and separate compartments which may be called the "machine room" and "travel shaft". The former, which is usually positioned above the latter, houses a hoisting winch together with the associated electrical control circuits; the latter on the other hand contains a cage for transporting persons, which is connected to the winch by means of a cable system and provided with a keyboard allowing selection of the desired floor to be stopped at, and a counterweight which, acting in opposition to the weight of the cage, allows a reduction in the force required by the winch to displace the cage and generation, between cable and pulley, of the friction required to prevent slipping of the said cable.

The presence of two separate compartments, made necessary by the considerable size of conventional winches, constitutes a considerable drawback both because it results in a significant increase in the cost of installation of the lift system and because it in fact limits the feasibility of installation in view of regulations which restrict the height of the buildings in which the system is to be installed.

BACKGROUND ART

In order to overcome this problem, small-size winches which may be housed inside the travel shaft have been designed. These winches use brushless motors or conventional asynchronous motors complete with reduction unit, but, although they are able to eliminate the need for construction of a special machine room, they nevertheless have various drawbacks which are evident in particular in emergency situations.

Brushless motors use permanent magnets. When controlling the movement of the cage with the break released, i.e. when it is required to perform direct mechanical control of the winch operation, as occurs for example in emergency situations, the gradual demagnetisation of the magnets results in a loss of rapidity. Any mechanical blockage on the guides may be eliminated only by supplying a large quantity of power which, causing jerks and jolts, results in loss of continuity in mechanical control over the cage.

Moreover, visual control of the winch is not possible and, during the emergency manoeuvre, the operator must regulate releasing of the break based on his own sensation and impression gained from a direct view of the cables alone.

Positioning of the winch along the upper part of the guides also results in a less efficient sliding action of the said guides on the anchoring brackets, in particular when the cage must perform long travel movements, as well as deformation due to the excessive peak load.

Finally, the costs are higher than those of conventional asynchronous motors.

Asynchronous motors used in combination with a reduction unit, however, occupy a large amount of space due to the use of reduction units consisting of an endless screw/helical crown wheel pair, said units also having a low output and therefore requiring the use of high-power motors and therefore the consumption of a large quantity of electrical energy.

During the emergency manoeuvres, the reduction unit is situated in a position which is hidden from the operator and this means that the latter must control displacement of the cage solely by releasing the break and therefore in a somewhat unsafe manner.

Moreover, as in the case of brushless motors, positioning of the winch along the upper part of the guides diminishes the efficiency and reduces the reliability of the latter, resulting in deformation thereof due to the excessive peak load.

DISCLOSURE OF THE INVENTION

The object of the present invention is therefore to eliminate the abovementioned drawbacks The invention, as it is characterized by the claims, achieves the object using a compact winch arranged so that its axis of rotation is parallel to the wall of the shaft and the cage next to which it is arranged. This is made possible by the use of a cage moving system devised so that the counterweight has a travel movement approximately equal to half that of the cage, therefore leaving free above it the space necessary for housing the winch there in the most advantageous position.

The main advantage obtained by means of the present invention consists essentially in the fact that it is possible to avoid the need for two separate compartments for housing the winch and the cage and, at the same time, provide the possibility of direct mechanical and visual control over the winch and the cage in emergency situations, i.e. when manual intervention by the operator is required. In fact, owing to the space available for housing the winch, it is possible to position the latter at a height allowing immediate viewing thereof by a person of normal height, for example at a height of between one and two meters from the ground of the highest floor reached by the cage.

Moreover, the possibility of fixing the winch using an independent support system, without there being any interference with the cage guides, ensures efficient operation of the latter over time, in particular in the case of long travel movements, preventing said guides from being subject to mechanical stresses causing deformation.

Owing to its dimensions and the fact that it is independent of the cage support and guide devices, the winch may also be positioned on any side of the shaft. Finally, the possibility of using mechanical parts, such as alternating-current induction motors or disk rather than drum brakes, allows a highly reliable and safe performance to be achieved, together with low energy consumption and reduced installation costs.

BRIEF DESCRIPTION OF THE DRAWINGS

Further advantages and the characteristic features of the invention will emerge more clearly from the following detailed description, provided with reference to the accompanying drawings which show a non-limiting example of embodiment thereof, in which.

DETAILED DESCRIPTION OF THE PREFERRED EMBODIMENT(S)

Figure 1:
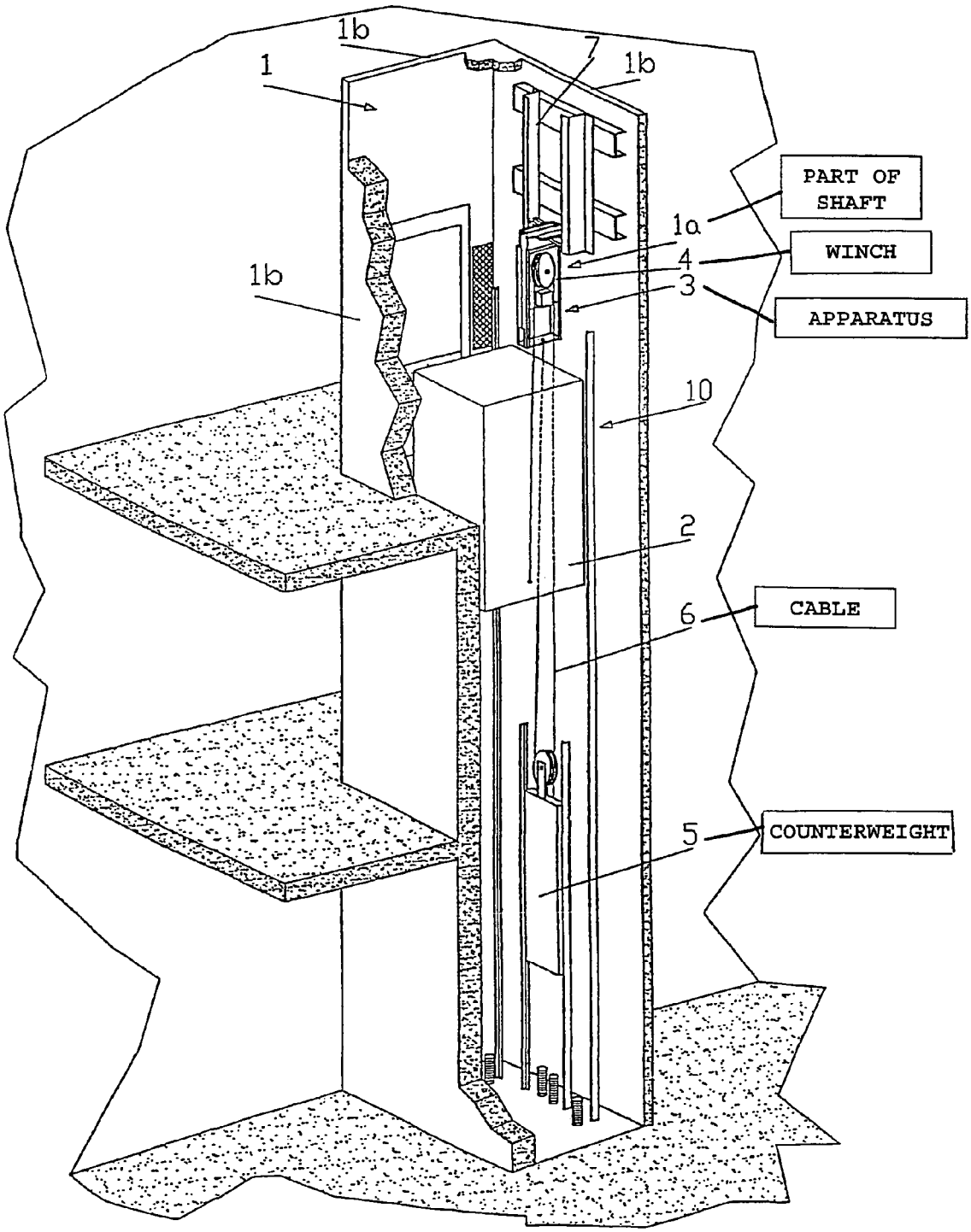
FIG. 1 shows a perspective view of the invention.
Figure 2:
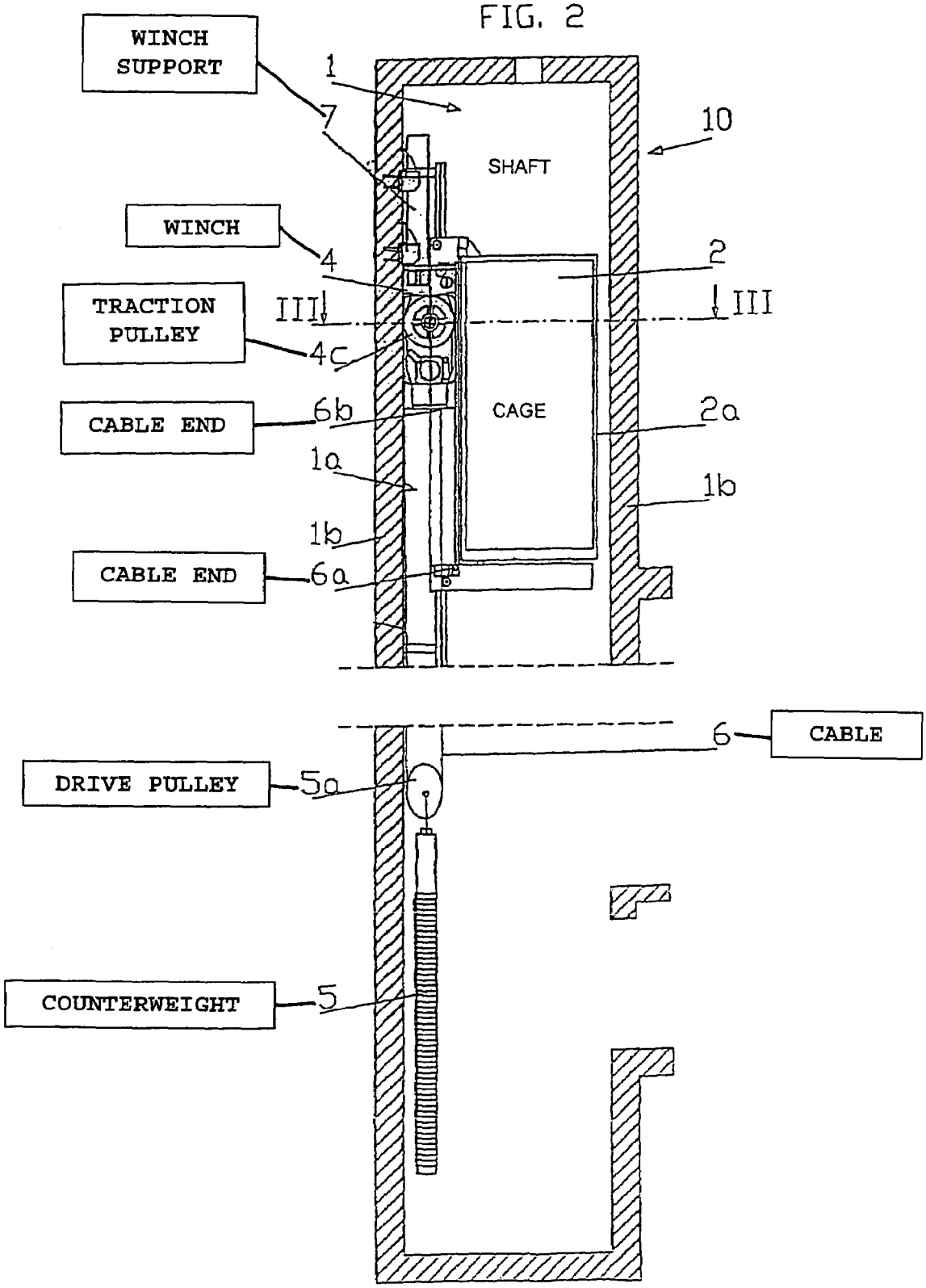
FIG. 2 shows a side view of the invention, with some parts removed so that others may be seen more clearly.
Figure 3:
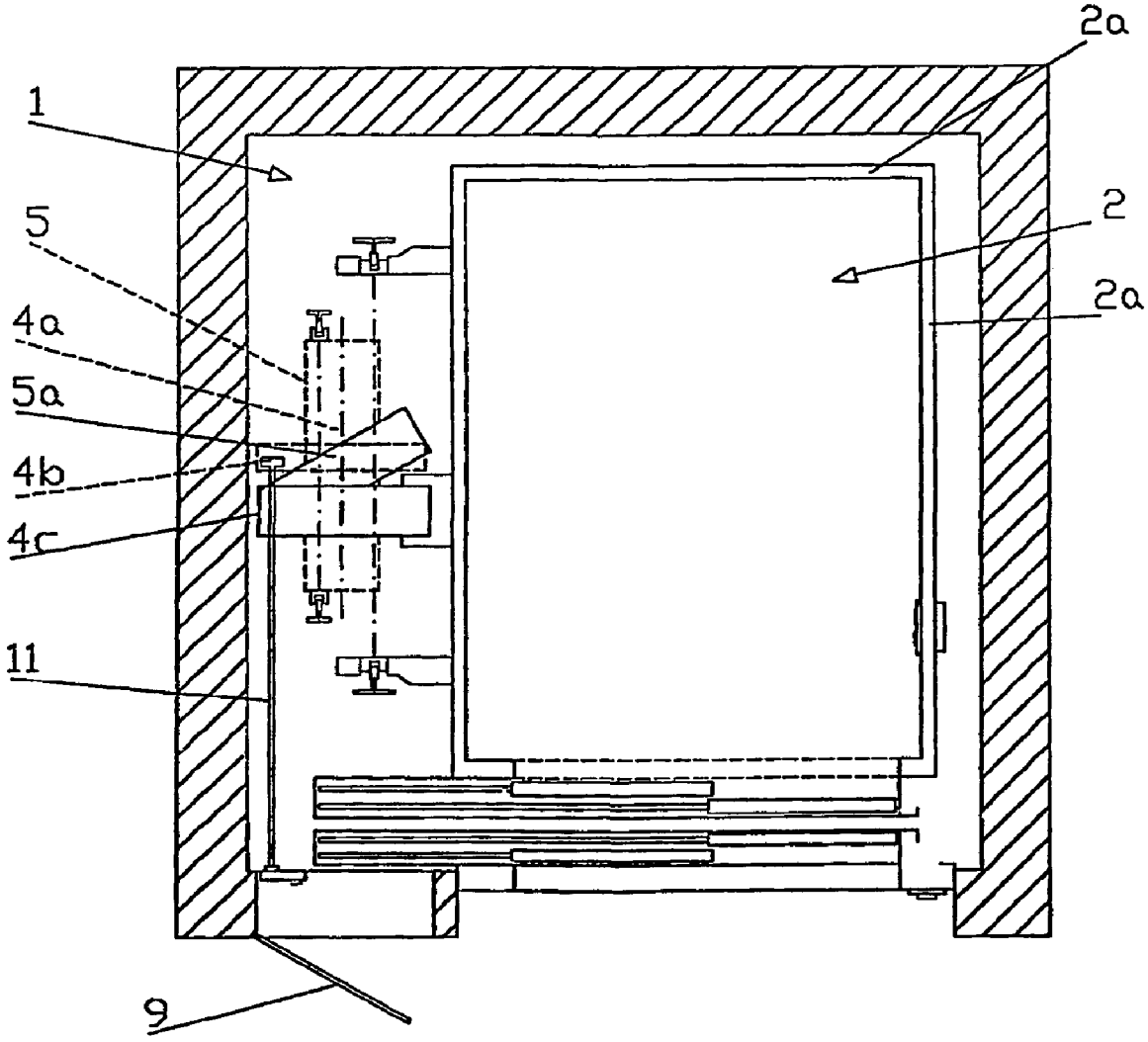
FIG. 3 shows a cross-sectional view of the invention along the line III—III according to FIG. 2.
Figure 4:
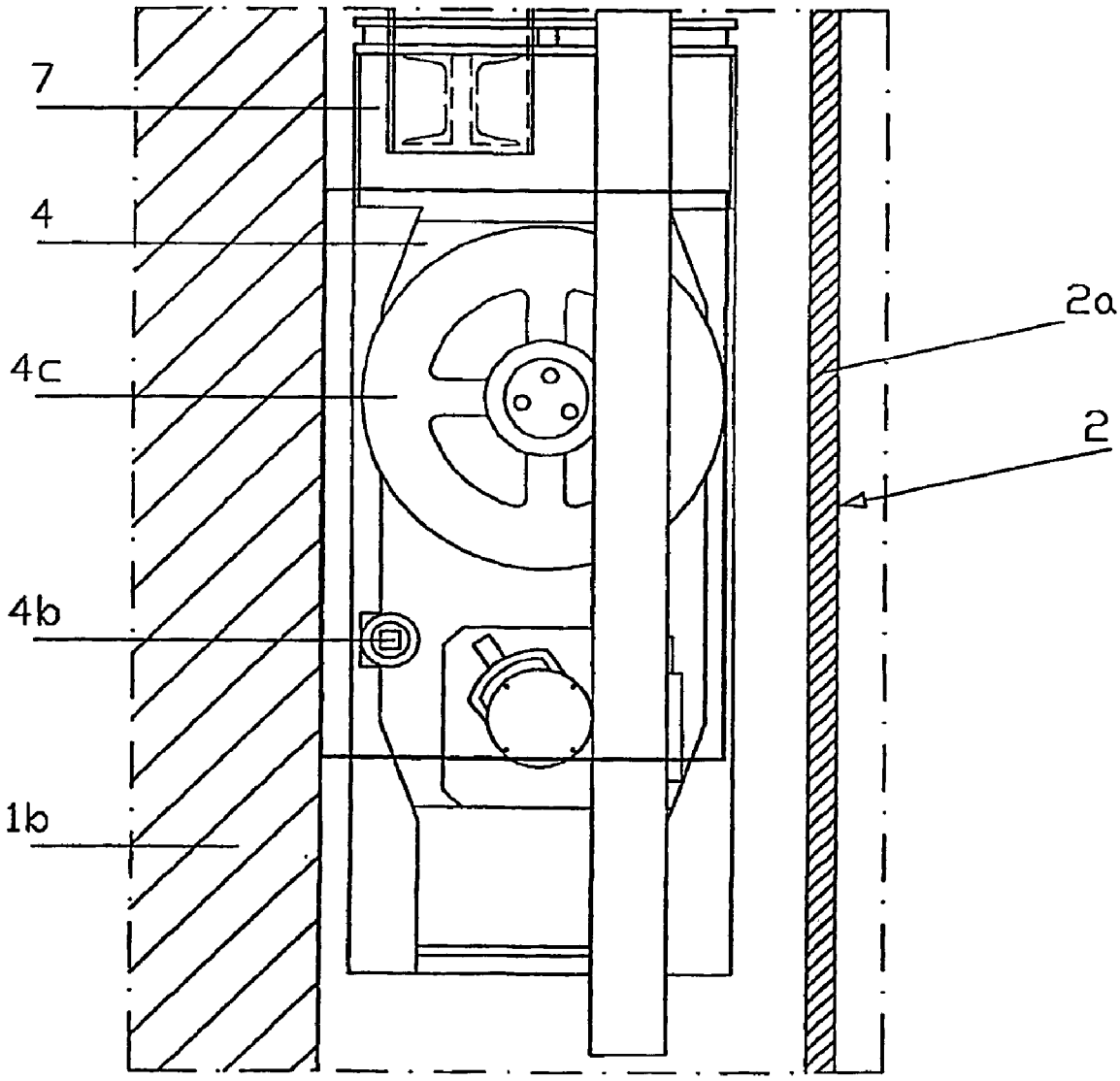
FIG. 4 shows a front view of a detail of the invention.

As can be seen from the figures, the invention relates to a cable lift of the type with a single compartment or shaft (1) for housing a movable cage (2) and an apparatus (3) for displacement of the cage (2). The apparatus (3) comprises at least one fixed winch (4), provided with a traction pulley (4*c*) over which a cable (6) travels, and a movable counterweight (5). The cable lift has the special feature that, for any displacement of the cage (2), the counterweight (5) performs travel movements shorter than those of the said cage (2) so that a space (1*a*) of the shaft (1) is always free so as to allow the winch (4) to be housed therein.

This is achieved using a drive pulley (5*a*): in fact, the cable (6) has one end (6*a*) attached to the cage (2), while the other end (6*b*), instead of being attached to the counterweight (5), as is usually the case, is fixed to the space (1*a*) of the shaft (1) which is never reached by the counterweight (5), after the cable (6) has passed over the pulley (5*a*). In this way each displacement of the cage (2) produces displacements of the counterweight (5) which are approximately halved and in the opposite direction.

A compact winch (4) such as that shown, equipped with a motor with a rating of 3–5 kW, is able to achieve a hoisting capacity of about 650 kg and an operating speed of up to 1 m/sec. Owing to its dimensions, together with the limited travel movement of the counterweight (5), the winch may be positioned between any wall (1*b*) of the shaft (1) and any wall (2*a*) of the cage (2) inside the space (1*a*) of the shaft (1) situated above the counterweight (5), i.e. approximately at the height of the last floor at which the cage (2) stops, and may be oriented so that the traction pulley (4*c*) has an axis of rotation (4*a*) parallel to the walls (1*b*, 2*a*) next to which it is arranged.

An arrangement of this kind allows the winch (4) to be totally independent of the structures required for supporting and guiding the movements of the cage (2): in fact, to be supported, the winch merely requires a support (7) fixed to a wall (1*b*) of the shaft (1).

The advantage arising therefrom consists in the fact that the guides of the cage (2) are able to slide freely in the anchoring elements, ensuring at the same time safe, silent and comfortable operation.

Among the various possible positions where the end (6*b*) of the cable (6) may be fixed, it is particularly advantageous, as shown for example in the figures, to position it immediately underneath the winch (4), attached to its support (7) which is suitably insulated so as to limit the spread of noise from the entire apparatus (3).

As regards the axis (4*a*) of the pulley (4*c*) of the winch (4), it is recommended that it be arranged at a height, with respect to the last floor at which the cage (2) stops, of between sixty centimeters and two meters ten centimeters, so as to allow direct frontal viewing of the winch (4) when, in emergency or maintenance situations, direct intervention by an operator is required.

For this purpose, a hatch (9) is provided, allowing access to the space (1*a*) of the shaft (1) where the winch (4) is housed. The latter comprises a seat (4*b*) for engagement of a tool (11) so that movement thereof may be manually and visually controlled, without the need for servocontrol systems. Therefore, in the event of an emergency, once the hatch (9) has been opened, the operator need merely insert the tool (11) (generally consisting of a rod) into the corresponding seat (4*b*), release the brake and, by means of the abovementioned tool (11), manually rotate the pulley (4*c*) and displace the cage (2), while keeping direct control, also visually, over the whole situation and achieving the same level of a safety which exists in a lift (10) with a separate machine room.

The invention thus conceived may be subject to numerous modifications and variations, all of which fall within the scope of the inventive idea. Moreover, all the details may be replaced by technically equivalent elements.

In practice, modifications and/or improvements are obviously possible, provided that they fall within the scope of the following claims.

The invention claimed is:

1. A cable lift comprising:

a single compartment or shaft (1) housing a movable cage (2) and apparatus (3) including at least one winch (4) with a cable fixed on a wall (16) in an upper space (1*a*) of the shaft (1) opposite a side wall of the cage (2) when the cage (2) is fully elevated in the shaft (1);

wherein the upper space (1*a*) is occupied only by the apparatus (3) during operation of the movable cage (2);

wherein the winch (4) has a traction pulley (4*c*) with an axis of rotation (4*a*) parallel to the wall (1*b*) on which the winch (4) is fixed and a traction pulley (4*c*) over which the cable travels and extends to travel around at least one drive pulley (5*a*) on a counterweight (5) for displacement of the cage (2);

wherein the cable (6) has a first end (6*a*) fixed to the cage (2) and a second end (6*b*) fixed in the upper space (1*a*);

wherein the counterweight (5) is always located below the cage (2) during ascent or descent of the cage (2); and wherein during any displacement of the cage (2), travel of the cable (6) around the drive pulley (5*a*) results in displacement of the counterweight (5) equal to substantially half the displacement of the cage (2).

2. The lift according to claim 1, comprising a support (7) on which the winch (4) is fixed, wherein the support is fixed to the wall (1*b*) of the shaft (1), so that the winch (4) is independent of structures which support and guide the cage (2).

3. The lift according to claim 1, wherein the end (6*b*) of the cable (6) is attached to the support (7) for the winch (4) 80 as to limit the spread of noise from the apparatus (3).

4. The lift according to claim 1, having a hatch (9) allowing access to the upper space (1*a*) of the shaft (1) inside which the winch (4) is housed.

5. The lift according to claim 1, wherein the axis (4*a*) of the pulley (4*c*) is located at a height, with respect to the last floor at which the cage (2) stops, of between sixty centimeters and two meters ten centimeters, so as to allow direct frontal viewing of the winch (4).

* * * * *